US006825814B2

(12) United States Patent
Hayes

(10) Patent No.: US 6,825,814 B2
(45) Date of Patent: Nov. 30, 2004

(54) ANTENNA

(75) Inventor: David Hayes, Winchester (GB)

(73) Assignee: Plasma Antennas Limited (GB)

( * ) Notice: Subject to any disclaimer, the term of this patent is extended or adjusted under 35 U.S.C. 154(b) by 160 days.

(21) Appl. No.: 10/312,220

(22) PCT Filed: Jun. 25, 2001

(86) PCT No.: PCT/GB01/02813

§ 371 (c)(1),
(2), (4) Date: Dec. 20, 2002

(87) PCT Pub. No.: WO02/01671

PCT Pub. Date: Jan. 3, 2002

(65) Prior Publication Data

US 2004/0041741 A1 Mar. 4, 2004

(30) Foreign Application Priority Data

Jun. 28, 2000 (GB) ..... 0015895

(51) Int. Cl.[7] ..... H01Q 19/06
(52) U.S. Cl. ..... 343/753; 343/754
(58) Field of Search ..... 343/753, 754, 343/701, 909; 342/368, 367, 373

(56) References Cited

U.S. PATENT DOCUMENTS 3,959,794 A * 5/1976 Chrepta et al. ..... 343/701
4,700,197 A * 10/1987 Milne ..... 343/837
5,729,239 A * 3/1998 Rao ..... 343/753
5,982,334 A * 11/1999 Manasson et al. ..... 343/785
6,313,803 B1 * 11/2001 Manasson et al. ..... 343/756

FOREIGN PATENT DOCUMENTS

WO WO 9831068 * 7/1998

* cited by examiner

*Primary Examiner*—Don Wong
*Assistant Examiner*—Ephrem Alemu
(74) *Attorney, Agent, or Firm*—Iandiorio & Teska

(57) ABSTRACT

An antenna comprising: (a) semi-conductor means (1) having upper and lower surfaces; the upper and lower surfaces having a pattern of electrically conducting regions; (b) first generating means (9, 10) for generating conducting plasma filaments of charged carrier between the upper and lower conducting regions; (c) radio frequency feed means (8) to selected ones of the conducting plasma filaments in order to couple radio frequency energy to or from the semi-conductor means; and (d) second generating means for selectively generating a pattern of conductive filaments between the surfaces of the semi-conductor means in order to reflect and thereby to focus an electromagnetic wavefront incident upon an edge of the semi-conductor means to at least one radio frequency feed point within the semi-conductor means; and the antenna being planar dielectric lens antenna with controlled conductive elements forming a direction antenna for the reception or transmission of a beam frequency energy in the plane of the semi-conductor means.

21 Claims, 10 Drawing Sheets

ANTENNA

This invention relates to an antenna and, more especially, this invention relates to an antenna enabling the adaptive control of beam shape and directivity of the antenna.

BACKGROUND OF THE INVENTION

Known conventional low-cost directive antennas typically comprise so-called end-fire arrays or dish or horn designs in order to obtain required directivity and beam shape. Angular direction is determined by mechanical orientation of the antenna. Beam shape is determined by the physical size and geometric form of the dish or horn. Other known directive antennas may be phased array antennas. A phased array antenna comprises a plurality of transmit or receive elements, each of which is essentially non-directive but whose co-operative effect may be a highly directive and steerable beam. Phased array antennas tend to be large, costly and complex.

It is well known that electromagnetic radiation may be directed and otherwise controlled through reflection from conducting surfaces. Examples of reflective control would include array antennas and aerials, and dishes such as are used in microwave receivers and transponders. Although normally associated with metallic high-conducting surfaces or elements, it has been shown that semi-conducting materials may also be used to reflect or otherwise modify electromagnetic radiation. Furthermore the degree of conductivity of a semi-conductor may be readily modified by the influence of incident illumination by light or the electrical injection of carriers, (T. S. Moss, "Optical Properties of Semiconductors", Butterworths, London (1959)). The rate of change of conductivity (recombination rate) and the amount of energy required to sustain the process is determined by the free carrier lifetime, which may be greatly influenced by known surface passivation techniques that serve to reduce crystalline dislocations and impurities within the semiconductor where free carriers can recombine. Typical semiconductors in widespread commercial use include, for example, Si, GaAs, InGaAsP, InP.

DESCRIPTION OF THE PRIOR ART

Intrinsic semiconductor materials may be doped with impurities to produce materials with precisely controlled conductivity. Light of sufficiently short wavelength, as may be determined by the bandgap $E_v$ characteristic of the semiconductor material, may be used to increase the density of free carriers in said semiconductors. Prior art shows that the intensity of an optical illumination changes the complex refractive index of semiconductors. The mechanism of this phenomenon is described by fundamental Drude theory, (see for example I Shih, "Photo-Induced. Complex Permittivity measurements of Semiconductors", 477 SPIE 94 (1984), and B Bennett, "Carrier Induced Change in Refractive Index of InP, GaAs, and InGaAsP", 26 IEEE J. Quan. Elec. 113 (1990).

Lev S. Sadovnik, et al (U.S. Pat. No. 5,305,123, LIGHT CONTROLLED SPATIAL AND ANGULAR ELECTROMAGNETIC WAVE MODULATOR, and U.S. Pat. No. 5,982,334, ANTENNA WITH PLASMA-GRATING) illuminated the surface of a semiconductor waveguide to produce adaptive diffraction gratings for angular and spatial control of electromagnetic radiation, and also used locally induced plasma to produce optically controlled switches (U.S. Pat. No. 5,796,881, LIGHTWEIGHT ANTENNA AND METHOD FOR THE UTILIZATION THEREOF).

The same researchers used PIN semiconductor structures to inject carriers into an intrinsic semiconductor to create a pattern of localised regions of high carrier density and thereby form a diffraction grating.

BRIEF DESCRIPTIONS OF THE INVENTION

It is an aim of the present invention to provide an antenna which can be manufactured at low cost and which can be used in a wide variety of applications.

Accordingly, in one non-limiting embodiment of the present invention, there is provided an antenna comprising:

(a) semi-conductor means having upper and lower surfaces, the upper and lower surfaces having a pattern of electrically conducting regions;

(b) first generating means for generating conducting plasma filaments of charged carriers between the upper and the lower conducting regions;

(c) radio frequency feed means to selected ones of the conducting plasma filaments in order to couple radio frequency energy to or from the semi-conductor means; and (d) second generating means for selectively generating a pattern of conductive filaments between the surfaces of the semi-conductor means in order to reflect and thereby to focus an electromagnetic wavefront incident upon an edge of the semi-conductor means to at least one radio frequency feed point within the semi-conductor means;

and the antenna being a planar dielectric lens antenna with controlled conductive elements forming a directive antenna for the reception or transmission of a beam of radio frequency energy in the plane of the semi-conductor means.

The antenna of the present invention may be a low cost adaptive antenna which is able to be used in a wide range of applications including, for example, telecommunications, radar, and tracking of base stations from vehicles to satellite or other such mobile links. The antenna of the present invention may be a broad-band width antenna with multi-beam directivity control. The antenna of the present invention may encompass relatively long centimetric radio-frequency wavelengths, through millimetric wavelengths to long optical wavelengths such as infrared wavelengths.

The first generating means is used to increase locally the carrier density within a semiconductor volume to produce the conducting plasma filaments. The conducting filamentary plasma is well confined to the volume between the surface regions of high conductivity, and it extinguishes rapidly in the absence of the first generating means. The locally defined conducting plasma filaments may be used firstly to reflect or absorb incidence electromagnetic radiation according to their carrier concentration within a wave-guiding structure such for example as a planar circular semi-conductor lens providing 360° coverage of controllable beam width and side lobe level. The locally defined conducting plasma filaments may be used secondly to provide an antenna feed means analogous to an electrical dipole or similar radio frequency feed within the wave guide structure.

The antenna may be one in which the regular matrix of filaments is in the form of a plurality of concentric rings of points thereby to enable simulation of a quasi-planar reflector.

The antenna may be one in which the first generating means is electrical bias means for providing an electrical bias potential between the said electrodes on the upper and lower surfaces. The semi-conductor medium may advantageously comprise a plurality of regions of differential impurity doping thereby to enhance carrier generation.

Alternatively, the antenna may be one in which the first generating means is optical projection system first generating means, and in which the antenna is controlled by selective illumination of the semi-conductor means through the optical projection system first generating means.

The optical projection system first generating means may comprise a plurality of the optical fibres which couple light to the surface of a layer of the semi-conductor means, the optical fibres being arranged so as to provide a plurality of light injection points in the form of a selectable array.

Usually, the antenna will be a flat circular dielectric lens antenna. Also usually, the semi-conductor means will be a semi-conductor plate. The semi-conductor plate may comprise selectively doped regions. Preferably the semi-conductor plate is a disc but other shapes for the semi-conductor plate may be employed if desired.

The antenna may include a shaped dielectric medium concentric with the perimeter of the semi-conductor means, whereby electromagnetic coupling between the antenna and an external medium is enhanced.

The antenna may be one in which the pattern of conducting plasma filaments is configured so as to focus electromagnetic energy from an external medium to a point feed within the semi-conductor means, a radio frequency feed at the focal point enabling electromagnetic coupling to or from the antenna.

The apparatus may be one in which the conducting plasma filaments are configured in patterns of sub-arrays such as to modify the beam shape and efficiency of the antenna. In this case, the conducting plasma filaments may be configured to produce multiple antenna beams.

The antenna may be one in which the conducting plasma filaments have a density which is controlled so as to enable reflected amplitude weighting within an array of elements.

The antenna may include a toroidal dielectric annulus in proximity with the perimeter of the semiconductor means, whereby electromagnetic coupling between the antenna and an external medium is enhanced.

The antenna may form part of a plurality of the antennas, the antennas being mounted in an array to enable elevation control of the resultant beam in conjunction with azimuthal control. In this case, the antennas are preferably mounted in a stack but other configurations may be employed if desired.

The antenna may be one in which the conducting plasma filaments are produced by other means, to include photoconduction, current injection, ferro-electric and ferromagnetic effects.

The antenna may be one in which the semi-conductor means comprises a semi-conducting dielectric medium of polycrystalline or amorphous form.

The antenna may be one in which the active medium is of photo-conductive or electro-conductive plastic.

The antenna may be one in which the beam of radio frequency energy which is controlled by the antenna is of wavelengths characteristic of electro-optics rather than microwave radio frequencies.

The antenna may be one which is designed by calculation of geometry and material properties to perform specific applications relating to telecommunications, radar, medical scanning, inspection or other forms of sub-surface imaging.

The antenna may be complemented to allow controlled reflection of an illuminating signal by varying the density of the filamentary plasma containing the plasma filaments, the antenna then functioning as a transponder capable of both directing and modulating a reflected signal.

At lower frequencies, where the diameter of the planar dielectric lens antenna approaches a half wavelength (in dielectric) and its thickness is very much less than half a wavelength (in dielectric), the active antenna begins to operate as a dielectrically-loaded steerage cavity-backed slot antenna. That is, upper and lower surfaces of the semi-conductor means form a waveguiding structure which can be further constrained by a conducting plasma wall to create a reconfigurable cavity. This reconfigurable cavity can be fed either by a metal feed or a plasma feed connected between the two major conducting surfaces of the semi-conductor lens. The semi-conductor means may be metallised. The position of such an unbalanced feed within the reconfigurable cavity will largely determine the feed's matching characteristics. As the operating frequency increases, a wide range of reconfigurable cavities can usefully be formed to include a range of wide-band horn structures (for example Vivaldi) which may be further adjusted to become complex reflecting surfaces that can sustain selective electromagnetic modes.

DESCRIPTION OF THE DRAWINGS

Embodiments of the invention will now be described solely by way of example and with reference to the accompanying drawings in which.

DESCRIPTION OF PREFERRED EMBODIMENTS

Figure 1:
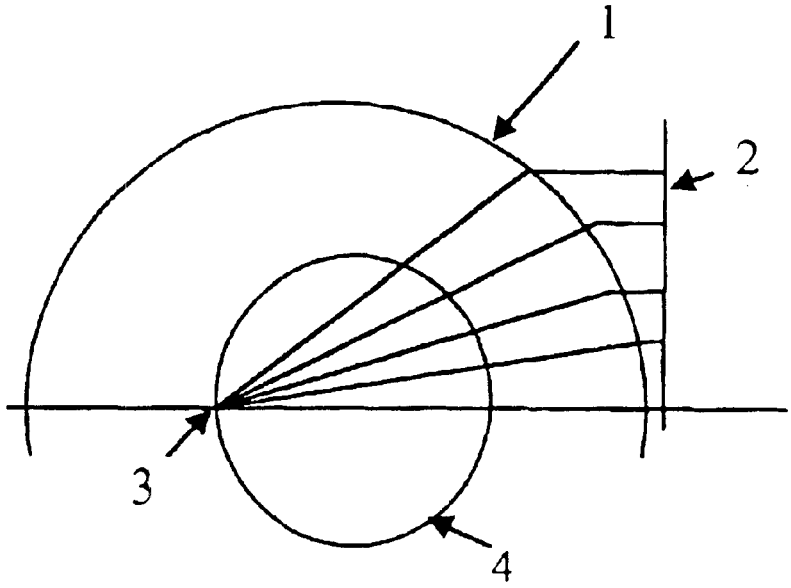
FIG. 1 illustrates the focusing effect of a dielectric disc.
Figure 2:
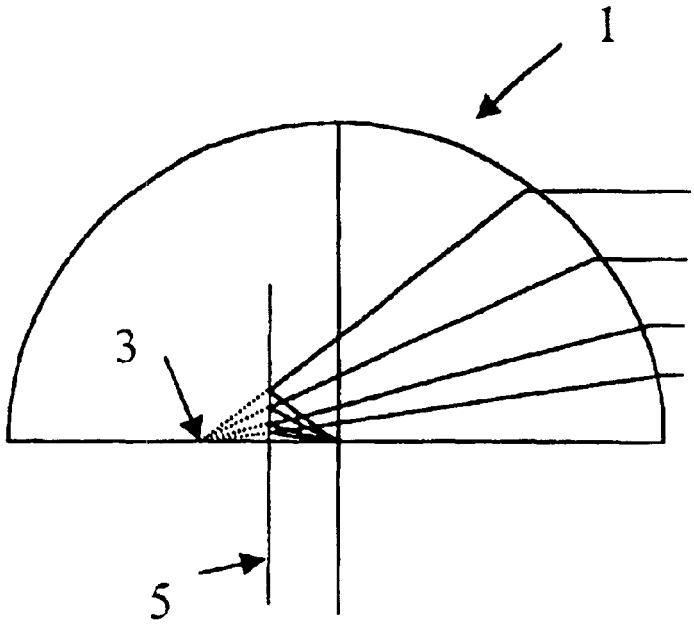
FIG. 2 illustrates how the focal point may be brought to the centre of the dielectric disc by means of a reflective plane.

The underlying principle of the present invention is illustrated in FIG. 1. FIG. 1 shows that a cylindrical disc 1 of refractive medium will to a close approximation, cause an incident planar wavefront 2 parallel to the plane of the disc 1 to be focused at a focal point 3. The focal point 3 lies on a circle 4 which is concentric with the perimeter of the disc 1. The radius of the focal circle is determined by the refractive index of the dielectric medium. The focal point 3 may be referred to the centre of the lens by reflection from a conducting plane 5 appropriately positioned as illustrated in FIG. 2.

Figure 3:
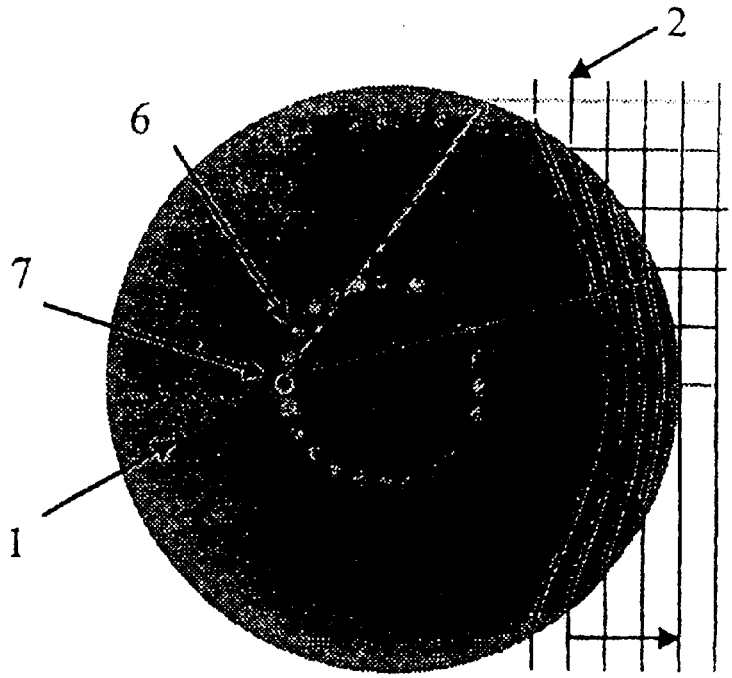
FIGS. 3 and 4 show in plan and side elevations respectively a plasma-fed circular antenna.
Figure 4:
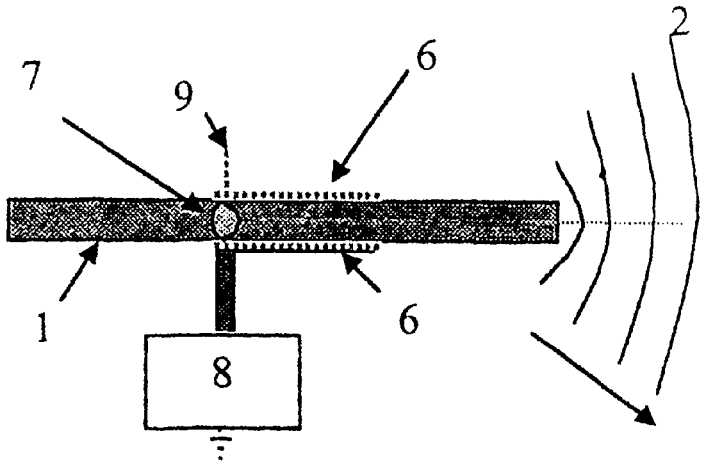
Figure 5:
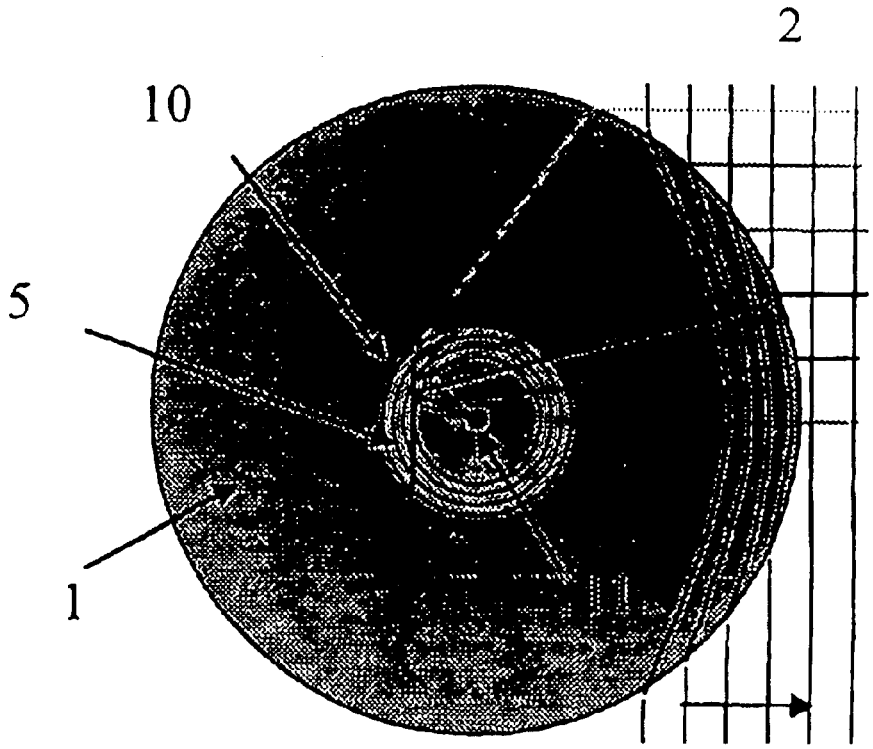
FIGS. 5 and 6 show in plan and side elevations respectively an optically controlled plasma mirror using fibre-optic plasma control means.
Figure 6:
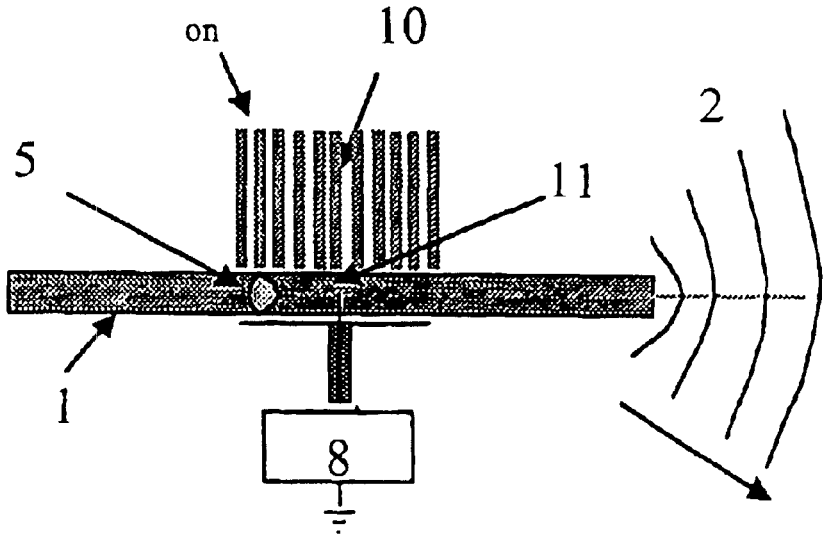

FIGS. 3 and 4 show a plurality of plasma feeds 6 which are positioned around the focal circle. An active "ON" plasma feed 7 is positioned at a focal point and it enables electromagnetic coupling to the refractive medium for the disc 1. In-active "OFF" plasma feeds illustrated should not influence the propagation of the electromagnetic radiation, avoiding beam blockage which is a known problem in alternative beam-forming geometries. The active plasma feed constitutes a radio frequency coupler that may be used to couple to or from the lens. A radio frequency transmitter or receiver 8 connects to the plasma feed. The plasma is excited in this case by generating carriers through a dc bias means 9. Alternatively, illustrated in FIGS. 5 and 6, an array of optical fibres 10 may be used to couple light of appropriately determined wavelength and energy to the selected focal point. Radio frequency energy may be coupled to the lens via an embedded conducting metallic feed 11, or by means of a plasma feed.

Figure 7:
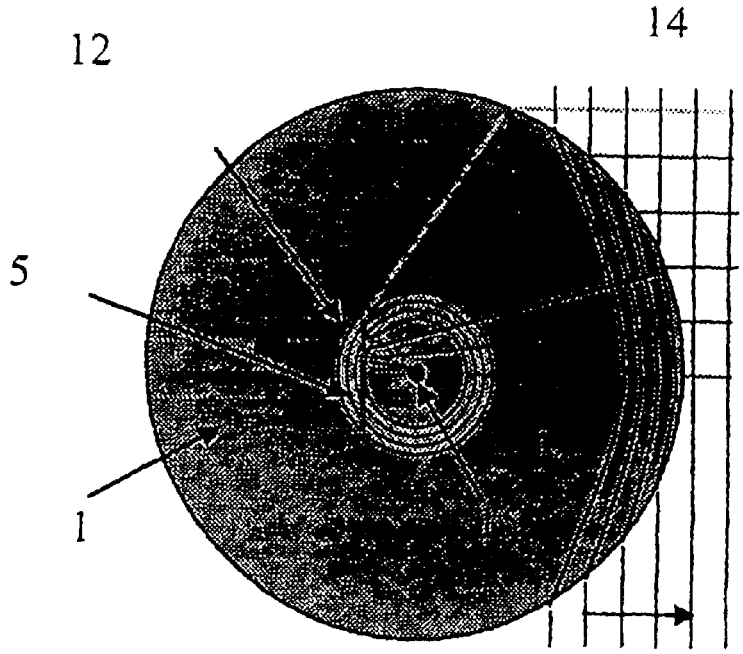
FIGS. 7 and 8 show in plan and side elevations respectively an electrically controlled plasma mirror using current injection plasma control means.
Figure 8:
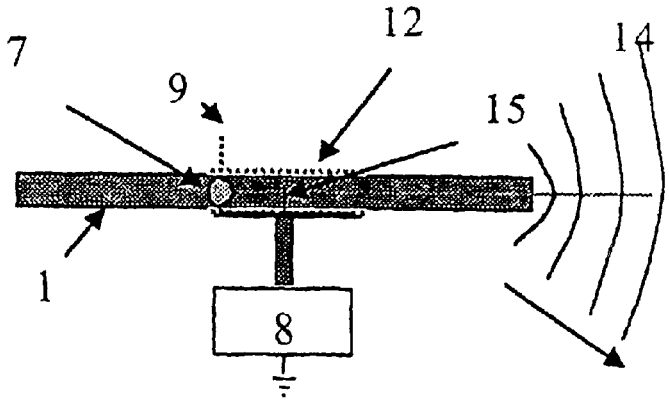

FIGS. 7 and 8 illustrate excitation of an array of plasma filaments using current injection 12 to present a reflective plane. The incident electromagnetic energy 13 is reflected by the said array to couple between an external wavefront 14 and a feed at the disc centre 15.

Figure 9:
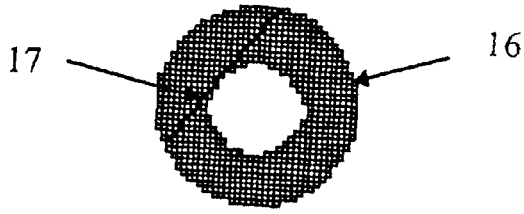
FIG. 9 shows schematically a typical plasma mirror control annulus.

Advantageously, the plasma matrix may be constructed as an array of electrodes forming an annulus 16 as illustrated in FIG. 9. A pseudo-flat or curved reflective plane may be simulated by selection of appropriate plasma elements 17. By such means, it will be appreciated that the resultant antenna directivity may be directly controlled through dynamic selection of appropriate plasma elements. By variation of the length of the reflective plane, the resulting beam width and side lobes of the antenna may be adjusted. Furthermore, selected plasma elements may be of reduced plasma density such that the resultant reflectivity and absorbtion are effectively modified. The phenomenon of so-called amplitude weighting may thereby advantageously be employed to modify the spatial coverage of the resultant antenna beam.

Figure 10:
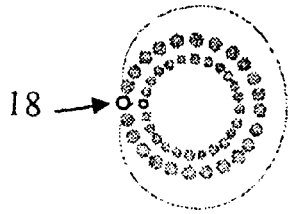
FIGS. 10 and 11 show schematically the implementation of two and four element directional end-fire feeds.
Figure 11:
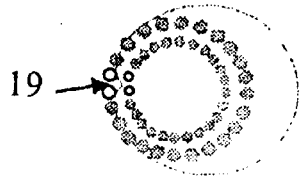

In an alternative implementation of the present invention, a cluster of selected plasma feed elements may be employed to effect a directional end-fire array. FIGS. 10 and 11 illustrate the concept of stimulating sets of plasma feed points 18, 19 to produce a multi-element end-fire array. Such described configurations may improve the efficiency of the antenna.

Figure 12:
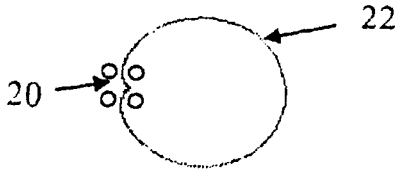
FIGS. 12 and 13 show schematically the implementation of a two-beam monopulse configuration.
Figure 13:
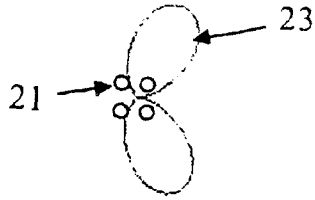

Implementation of known multi-element antenna techniques such as so-called "monopulse" tracking systems may be implemented by the present invention such as illustrated schematically in FIGS. 12 and 13. Feed points 20, 21 are appropriately spatially separated and temporally driven to effect a desired composite sum 22 and difference beams.

Figure 14:
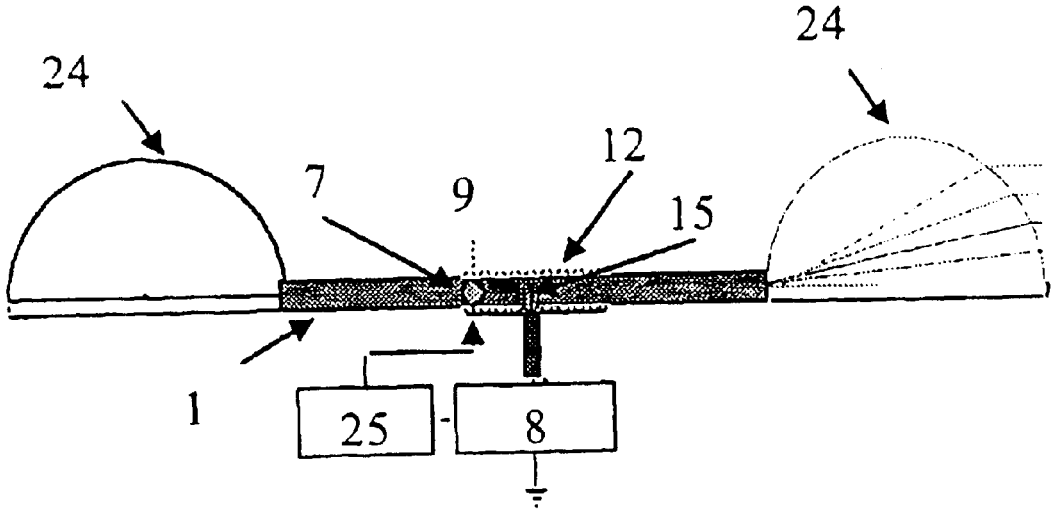
FIG. 14 illustrates the implementation of the antenna of the invention as a low-cost tracking system.

Electromagnetic coupling between a free-space environment and the semi-conductor medium utilised in the semiconductor means of the antenna of the present invention may advantageously be enhanced by incorporation of an intermediary medium. The intermediary medium for impedance matching purposes may be implemented for example by incorporation of an annular toroid around the periphery of a semiconductor disc. The geometry and dielectric characteristics of the matching toroidal medium will be selected so as to enhance the efficiency of the electromagnetic coupling. FIG. 14 illustrates implementation of the present invention as a low cost tracking system incorporating an impedance matching toroidal dielectric lens 24 and plasma reflector control electronic means 25.

Figure 15:
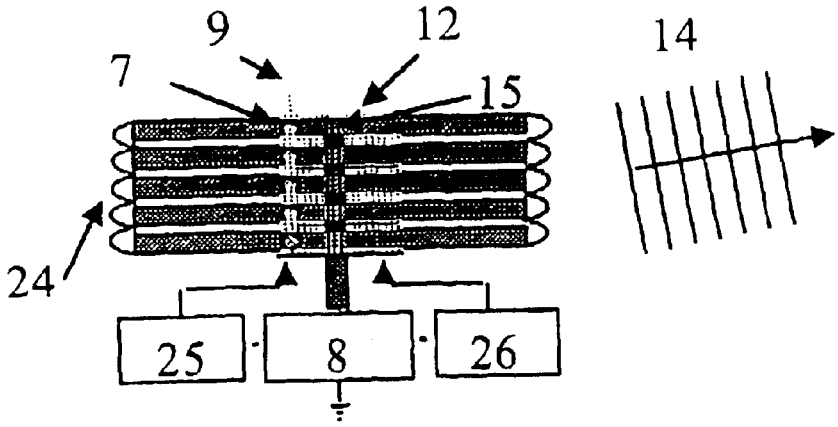
FIG. 15 illustrates the implementation of the antenna of the invention as a high gain tracking system with elevation control.

The present invention may advantageously be implemented in the form of a plurality of the antennas constructed in an array in the form of a vertical stack. Separate control of the phase or temporal delay of the radio frequency drive signal to each element of the stack results in control of the elevation of the combined output or by analogy reception pattern. FIG. 15 illustrates implementation of the present invention as a stacked array system with electronic control means 26 for application such for example as satellite tracking from a moving platform.

Active antennas may be used in a number of civil sensor applications including, for example, medical scanning, product inspection, collision avoidance radar, security and perimeter protection, and positioning and landing systems.

Of particular importance is the frequency at which the sensors may operate, which can extend into the Tera-Hertz (THz) regions, for example greater than 100 GHz. At these frequencies, sub-millimetre resolutions become possible and the incorporation of the active antenna directly on to the semi-conductor substrate results in an efficient, totally integrated, very low cost design.

Figure 16:
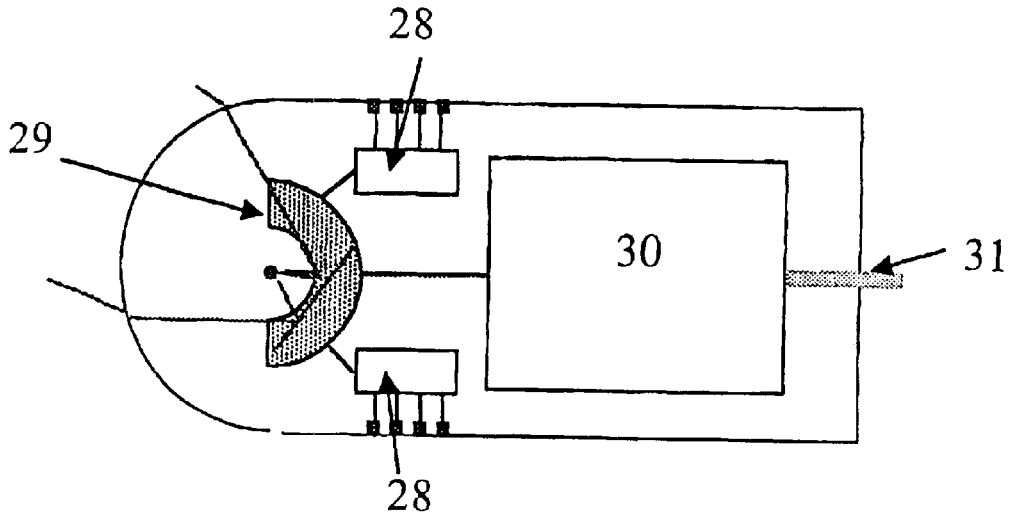
FIG. 16 illustrates the implementation of the antenna of the invention as a simple element of a micro-radar system.

FIG. 16 shows a THz micro-radar concept on a single monolithic substrate 27, where frequencies of very short pulses (eg ps) may be generated to image a small localised volume of surrounding space (for example a tooth) and provide a sub-surface detail (for example a cavity). The substrate contains a control means 28 to steer the integrated active antenna 29, as previously described, but with an integrated photo-conducting feed to produce a controllable THz beam. The antenna is fed optically by an optical synthesizer and optical matched filter 30, which is driven directly from a pulse laser 31. Such very high resolution radars may provide a safer alternative to x-rays.

Figure 17:
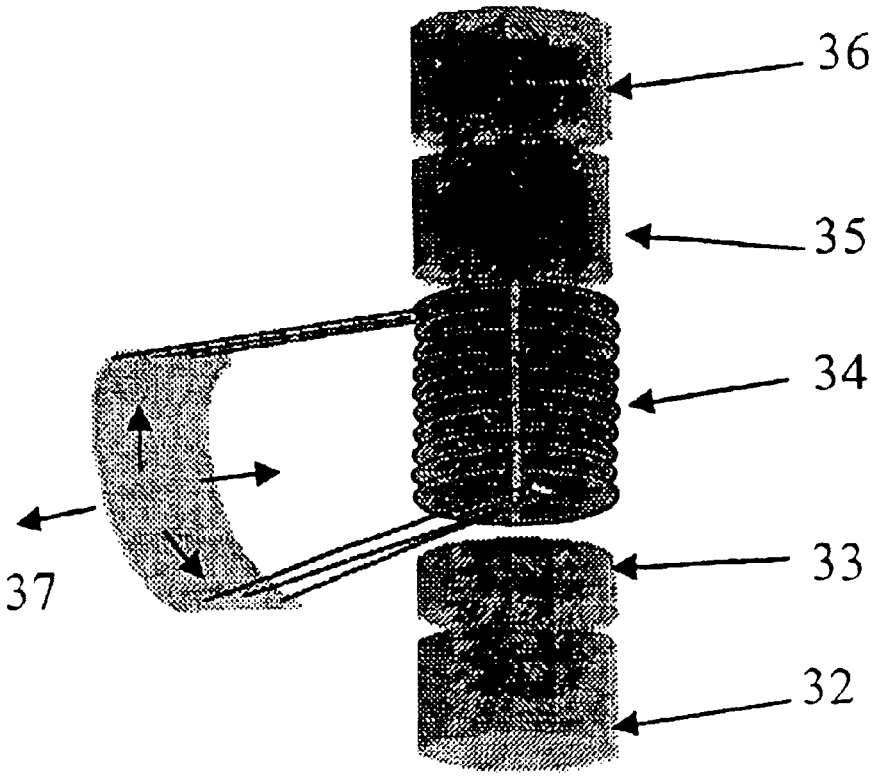
FIG. 17 illustrates the implementation of the antenna of the invention as a micro-radar system using a vertical array of cylindrical active antennas.

FIG. 17 illustrates by way of example how a 300 GHz photonic micro-radar might be produced as an early prototype and a stepping stone to more fully integrated versions. In this design, the THz pulse is generated at the centre of the circular antenna by photo-stimulating a localised band-gap transition in an embedded crystalline material using a short pulse laser. More specifically, a pulse control unit 32 drives a solid state laser 33, which in turn feeds a cylindrical array of active antennas 34. The received signal is translated into optical form and amplified by an erbium doped fibre amplifier and fed directly into optical matched signal processing 36.

Thus the system produces a steerable transmit/receive pulse 37, which can be processed tomographically. Alternatively, the THz signal may be synthesized at lower frequency, for example 100 GHz, and tripled using a non-linear device. In this case, the entire process may be effected electronically.

Essentially, the same type of device may be used to locally penetrate all forms of body tissue and bone. The device has the advantage over X-rays of generating much lower levels of radiation and therefore is potentially less harmful to both the patient and the operator. With high levels of integration, the system is also likely to be much cheaper than equivalent X-ray machines.

Figure 18:
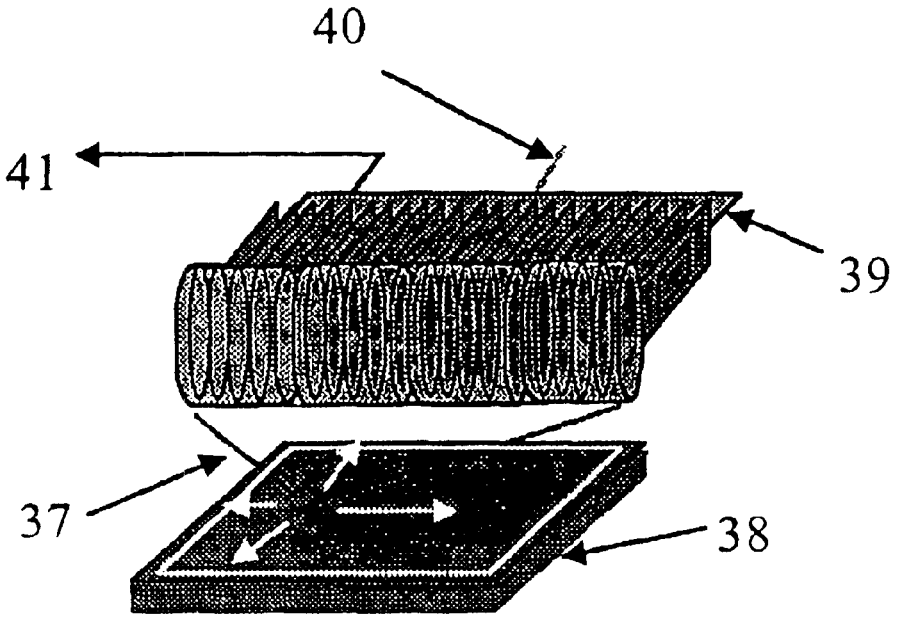
FIG. 18 illustrates the implementation of the antenna of the invention as a micro-radar system used for example for the inspection of micro-circuits.

THz micro-radars may also be used for small product inspection and quality control. FIG. 18 illustrates how a micro-radar's scanning beam 37 using integrated active antennas of the type shown in FIG. 16 may be used to inspect encapsulated integrated circuits 38 or similar objects. In this design, a photonic beam-former shares the optical pulse from a laser 40 on transmit. The same beam-former may be used on receive to route the optical signal to a processing and control unit 41 for analysis.

In conjunction with an interrogating system, the antenna of the present invention, for example as illustrated in FIGS. 3-16 may also be used as a passive transponder, wherein the plasma filaments 5 or the embedded feed 11 are individually or jointly modulated or impedance loaded in such a way as to change the directed reflectivity of the antenna.

Figure 19:
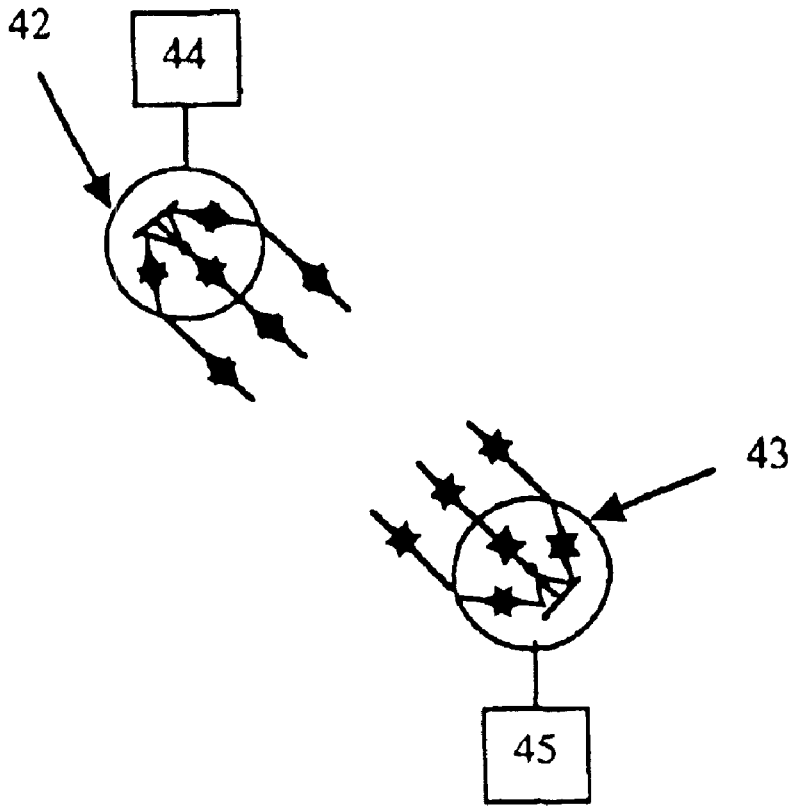
FIG. 19 illustrates the implementation of the antenna of the invention as an interrogating system.

As an example of such an implementation, FIG. 19 shows an interrogating system 42, a directed transmit and receive control unit 44, and a transponding system 43 with a receive and reflect control unit 45. By first determining the angle of arrival of a received interrogating signal and then responding at the determined angle with a modulated reflection, a communications link may be established between the interrogating system 42 and the transponding antenna 43. Thus, the transponding antenna 43 in conjunction with its controlled unit 45, retro-directs back to the interrogator, modulated responses without the need for or expense of a power-consuming transmitting device, and at reduced radiation risk to those near the transponder. The transponder may also be used to reflect the signal to other receivers or known angular positions (not shown).

As will be appreciated from the above description of the drawings, the antenna of the present invention is able to provide a reflective means of controlling directivity, thereby avoiding the loss and band-width limitation of known phased array antennas.

The antenna of the invention is an adaptive antenna. Thus the antenna is such that an electromagnetic beam may advantageously be directed in a particular direction with energy largely confined within a designed angular extent. By reciprocity, such an antenna may be used as an element of a receiver having acceptance over the same angular coverage. The antenna of the present invention may be compact and rugged, with the potential for low-cost production and maintenance.

As indicated above, the essential element of the beam-forming means is the generation of a reflective filament or plasma within a semi-conducting medium. A photo-injected or electrically-injected high density of charged carriers affects the propagation of an electromagnetic wave through modification of the dielectric permittivity of the medium within that volume. At a sufficient, and readily calculated, density of carriers, efficient reflection of the electromagnetic wave results. A pattern of conducting areas is formed within the semi-conductor volume such as to cause an electromagnetic beam to be favourably emitted or received over a particular and controlled solid angle.

The antenna of the present invention thus enables a compact (solid-state) antenna to be directed at, or dynamically to track, a targeted position in space, which might typically be a terrestrial or orbital transmitter, receiver or transponder. The antenna of the present invention thus finds applications in the fields of mobile telecommunications, global positioning by satellite, "last-mile" telecommunication distribution, collision avoidance, and efficient broadband data transmission such as WAP.

It is to be appreciated that the embodiments of the invention described above with reference to the accompanying drawings have been given by way of example only and that modifications may be effected. Thus, for example, the various components of the antenna as shown in the drawings need not be in the illustrated shapes or in the illustrated assembled configurations. Other shapes and configurations may be employed.

What is claimed is:

1. An antenna comprising:

(a) semi-conductor means having upper and lower surfaces, the upper and lower surfaces having a pattern of electrically conducting regions;

(b) first generating means for generating conducting plasma filaments of charged carriers between the upper and lower conducting regions;

(c) radio frequency feed means to selected ones of the conducting plasma filaments in order to couple radio frequency energy to or from the semi-conductor means; and (d) second generating means for selectively generating a pattern of conductive filaments between the surfaces of the semi-conductor means in order to reflect and thereby to focus an electromagnetic wavefront incident upon an edge of the semi-conductor means to at least one radio frequency feed point within the semi-conductor means;

and the antenna being a planar dielectric lens antenna with controlled conductive elements forming a directive antenna for the reception or transmission of a beam of radio frequency energy in the plane of the semi-conductor means.

2. An antenna according to claim 1 in which the regular matrix of filaments is in the form of a plurality of concentric rings of points thereby to enable simulation of a quasi-planar reflector.

3. An antenna according to claim 1 in which the first generating means is electrical bias means for providing an electrical bias potential between the said electrodes on the upper and lower surfaces.

4. An antenna according to claim 1 in which the antenna is a flat circular dielectric lens antenna.

5. An antenna according to claim 1 in which the semi-conductor means is a semi-conductor plate and in which the semi-conductor plate comprises selectively doped regions.

6. An antenna according to claim 1 and including a shaped dielectric medium concentric with the perimeter of the semi-conductor means, whereby electromagnetic coupling between the antenna and an external medium is enhanced.

7. An antenna according to claim 1 in which the pattern of conducting plasma filaments is configured such as to focus electromagnetic energy from an external medium to a point feed within the semi-conductor means, a radio frequency feed at the focal point enabling the electromagnetic coupling to or from the antenna.

8. An antenna according to claim 1 in which the conducting plasma filaments have a density which is controlled so as to enable reflected amplitude weighting within an array of elements.

9. An antenna according to claim 1 and including a toroidal dielectric annulus in proximity with the perimeter of the semi-conductor means, whereby electromagnetic coupling between the antenna and an external medium is enhanced.

10. An antenna according to claim 1 in which the conducting plasma filaments are produced by other means, to include photo-conduction, current injection, ferro-electric and ferro-electromagnetic effects.

11. An antenna according to claim 1 in which the semi-conductor means comprises a semi-conducting dielectric medium of polycrystalline or amorphous form, and in which the active medium is of photoconductive or amorphous form, and in which the active medium is of photoconductive or electroconductive plastic.

12. An antenna according to claim 1 and implemented to allow controlled reflection of an illuminating signal by varying the density of the elementary plasma containing the conducting plasma filaments, the antenna then functioning as a transponder capable of both directing and modulating a reflected signal.

13. An antenna according to claim 1 in which the first generating means is optical projection system first generating means, and in which the antenna is controlled by selective illumination of the semi-conductor means through the optical projection system first generating means.

14. An antenna according to claim 13 in which the optical projection system first generating means comprises a plurality of the optical fibres which couple light to the surface of a layer of the semi-conductor means, the optical fibres being arranged so as to provide a plurality of light injection points in the form of a selectable array.

15. An antenna according to claim 1 in which the conducting plasma filaments are configured in patterns of sub-arrays such as to modify the beam shape and efficiency of the antenna.

16. An antenna according to claim 15 in which the conducting plasma filaments are configured to produce multiple antenna beams.

17. An antenna according to claim 1 which forms part of a plurality of the antennas, the antennas being mounted in an array to enable elevation control of the resultant beam in conjunction with azimuthal control.

18. An antenna according to claim 17 in which the array is a stack.

19. An antenna according to claim 1 in which the diameter of the flat dielectric lens antenna approaches a half wavelength (in dielectric), and its thickness is very much less than half a wavelength (in dielectric), whereby the antenna is able to operate as a dielectrically-loaded, steerable cavity-backed slot antenna in which the upper and lower conducting surfaces of the semi-conductor form a waveguiding structure which can be further constrained by a conducting plasma wall to create a reconfigurable cavity.

20. An antenna according to claim 19 in which the cavity is fed either by a metal feed or a plasma feed, which metal feed or plasma feed is connected between the two major conducting surfaces of the semi-conductor means.

21. An antenna according to claim 20 in which the semi-conductor means is metallised.

* * * * *